US005157364A

United States Patent [19]

Pond et al.

[11] Patent Number: 5,157,364

[45] Date of Patent: Oct. 20, 1992

[54] AIRLINE TRANSMISSION STRUCTURES IN LOW TEMPERATURE CO-FIRED CERAMIC

[75] Inventors: Ramona G. Pond, Downey; Louis W. Hendrick, Hermosa Beach; Craig K. Shoda, Torrance, all of Calif.

[73] Assignee: Hughes Aircraft Company, Los Angeles, Calif.

[21] Appl. No.: 712,176

[22] Filed: May 22, 1991

[51] Int. Cl.[5] ..... H01P 1/203; H01P 1/205; H01P 5/00

[52] U.S. Cl. ..... 333/203; 333/204; 333/246

[58] Field of Search ..... 333/202, 203, 204, 205, 333/238, 244, 246, 247; 357/80

[56] References Cited

U.S. PATENT DOCUMENTS 4,849,722 7/1989 Cruchon et al. ..... 333/246 X
4,899,118 2/1990 Polinski, Sr. ..... 333/246
4,904,966 2/1990 Rubin ..... 333/246 X

*Primary Examiner*—Eugene R. Laroche
*Assistant Examiner*—Seung Ham
*Attorney, Agent, or Firm*—Terje Gudmestad; W. K. Denson-Low

[57] ABSTRACT

An airline transmission structure in a low temperature co-fired ceramic ("LTCC"). A cavity is made within the LTCC structure. Ground planes surround the cavity. Electronic processing circuitry, such as an airline filter, is suspended within the cavity. Transmission lines are provided to connect the electronic circuitry to the electronic signals (typically microwave) which require processing. Full integration of the airline filter with other electronic circuitry in a single LTCC package is also shown.

11 Claims, 2 Drawing Sheets

Fig. 1.
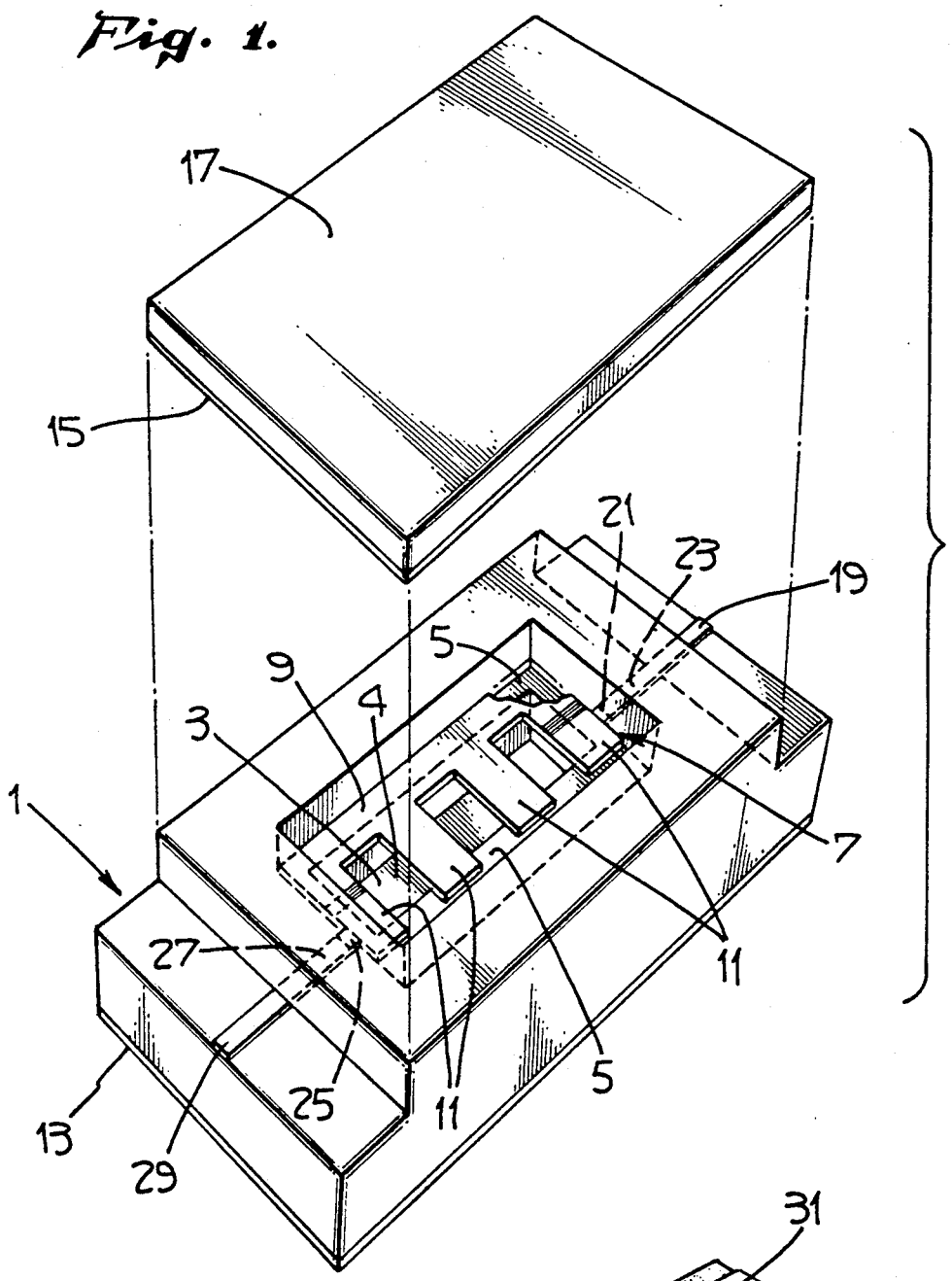
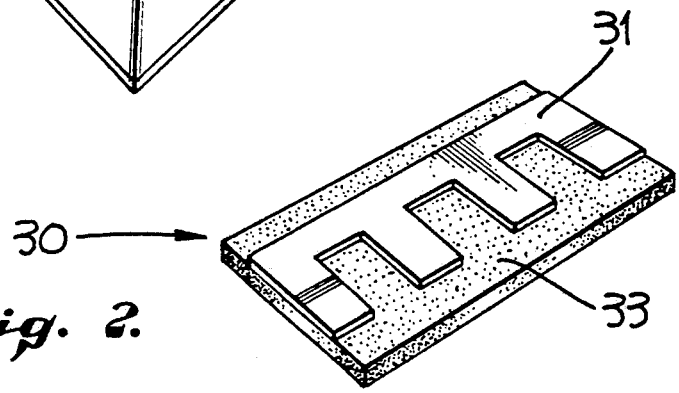
Fig. 2.

AIRLINE TRANSMISSION STRUCTURES IN LOW TEMPERATURE CO-FIRED CERAMIC

BACKGROUND OF THE INVENTION

1. Field of The Invention

This invention relates to low temperature co-fired ceramics ("LTCC") and, more particularly, to the use of airline structures in conjunction with such devices.

2. Description of Related Art

Low temperature co-fired ceramics ("LTCC") is a developing technology which facilitates high density integration of electronic circuitry in packages which are relatively inexpensive to fabricate.

The dielectric constant of the ceramic material, however, is relatively high. This causes signal losses which often reach unacceptable levels at high frequency. As a consequence, difficulties have been encountered in using this technology to process R.F. and microwave signals.

One effort to solve this problem has been to combine traditional airline structures in machined-out metal housings with electronic circuitry in LTCC structures.

This effort, however, has also met with problems. The resulting system is large and heavy. Construction of these devices is also quite expensive. It requires precision metallic machining, the joining of two different types of systems, and the tracking of all of the components needed in the construction of this combined system.

SUMMARY OF THE INVENTION

One object of the present invention is to obviate these and other problems in the prior art.

Another object of the present invention is to provide airline structures which can be used in connection with LTCC technology which are very small and light in weight.

A still further object of the present invention is to provide airline structures which can be used in conjunction with LTCC technology which are relatively inexpensive to construct.

A still further object of the present invention is to provide an environment in LTCC structures for processing high frequency signals (e.g. in the microwave range) with minimal insertion losses.

A still further object of the present invention is to passively condition high frequency signals in LTCC structures.

A still further object of the present invention is to provide airline structures which can be integrally associated with electronic circuitry in LTCC structures without the necessity for special attachments and which can be produced in high volume at low cost.

A still further object of the present invention is to embed airline filters in LTCC structures.

These as well as still further objects, features and benefits of the present invention can be achieved by creating a cavity in an LTCC structure, by surrounding the cavity with metallic ground planes, and by suspending the desired electronic processing circuitry within the cavity.

The ground planes can advantageously be formed through metallization of the bottom of the cavity and the underneath side of its cover. The air within the cavity serves as a low-loss dielectric.

Several types of microwave processing circuitry are shown in the preferred embodiments. These include a combline filter using a template, a combline filter supported on a thin, low loss dielectric substrate, and an edge-coupled filter made by a plurality of taut ribbons. All of these filter elements are suspended within the cavity. Full exploitation of the invention involves integrating other associated electronic circuitry in the same LTCC package as the airline configuration.

These as well as still further objects, features and benefits of the present invention will now become apparent from an examination of the following detailed description of the preferred embodiments, taken in conjunction with the accompanying drawings.

BRIEF DESCRIPTION OF THE DRAWINGS

FIG. 1 illustrates one embodiment of the present invention using a suspended metallic template element as part of a combline filter.

FIG. 2 illustrates a combline filter element supported on a low-loss dielectric substrate which can be used in lieu of the template element shown in FIG. 1.

DESCRIPTION OF THE PREFERRED EMBODIMENTS

Figure 3:
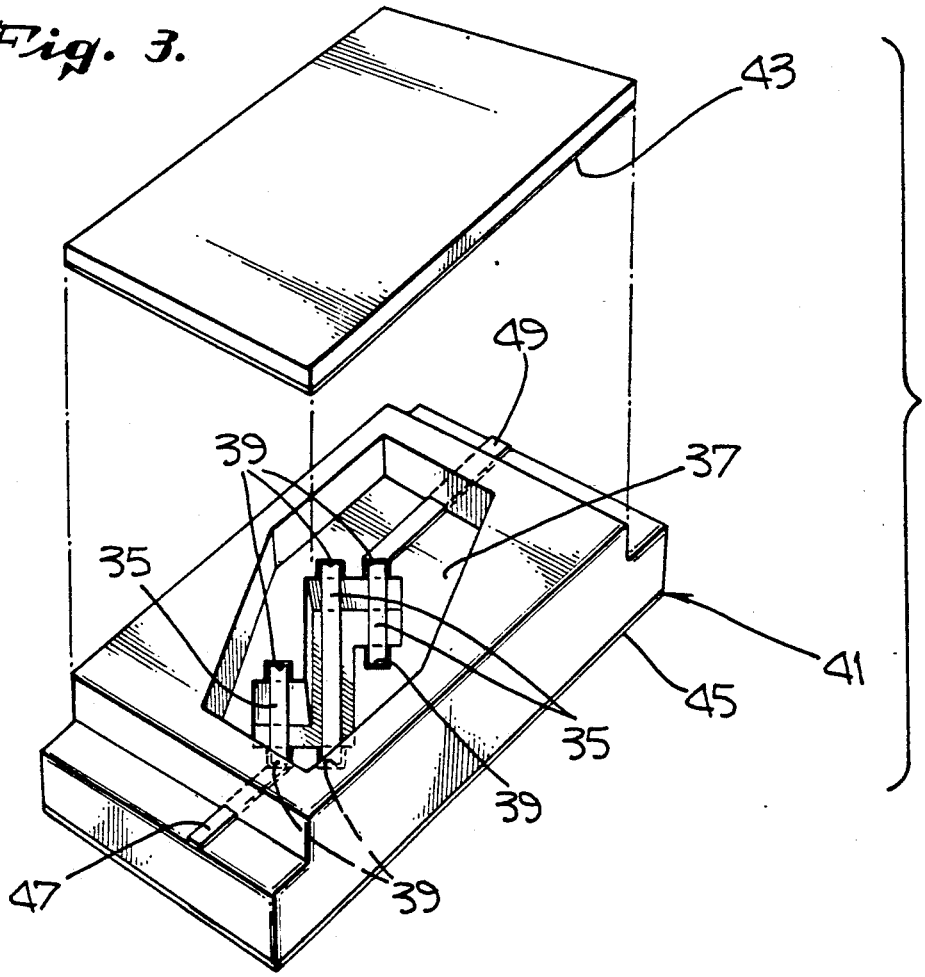
FIG. 3 illustrates another embodiment of the present invention using a plurality of suspended ribbons to create an edge-coupled filter.

FIG. 1 illustrates one embodiment of the present invention in which a template of a combline filter is suspended in a metallized cavity in an LTCC structure.

As shown in FIG. 1, an LTCC structure 1 has a cavity 3 formed therein. At the approximate center of the cavity 3, a shelf 5 has been formed so as to support a metal template 7 which is placed on the shelf 5.

The template 7 is a metallic combline filter element having a spine 9 and a plurality of resonating stubs 11.

The LTCC airline filter shown in FIG. 1 further includes a bottom ground plane 13 affixed to the underneath side of the LTCC structure 1 (or it can be alternaltely affixed to a bottom of the cavity 4), a top ground plane 15 affixed to the underneath side of a cover 17, a microstrip transmission line 19 affixed to the ceramic package 1 for bringing in the electronic signal to be processed, a second microstrip transmission line 21 affixed to the LTCC structure 1 for connection to one of the resonating stubs 11, and a stripline transmission line 23 for electrically connecting the microstrip transmission line 19 to the microstrip transmission line 21.

The template 7 is soldered or epoxyed (using conductive epoxy) to the shelf 5. The portion of the shelf 5 which comes in contact with the spine 9 of the template 7 is plated and serves as an electrical ground for the template 7. The bottom ground plane 13, the top ground plane 15, and the longitudinal portion of the shelf 5 which grounds the spine 9 can advantageously be electrically interconnected using a via network (not shown).

To allow connection to the output signal, a microstrip transmission line 25 is connected to another one of the resonating stubs 11. The signal is then delivered to a stripline transmission line 27 and then to an output microstrip transmission line 29.

In the preferred embodiment, microstrip and stripline transmission lines all have a 50 ohm impedance. The resonating stubs 11 are electrically connected to their respective microstrip transmission lines using wire bonding. The cover 17 can be affixed to the LTCC structure 1 using solder or conductive epoxy. The entire package typically may have a height of 0.15 inches and a width of 0.3 inches.

FIG. 2 illustrates a fully supported combline filter element on a thin, low-loss dielectric substrate which can be used in lieu of the template 7 shown in FIG. 1.

As shown in FIG. 2, a supported combline filter 30 includes a combline filter element 31 supported by a thin, low-loss dielectric substrate 33. Typically, the filter element 31 would be a layer of foil which is left after etching of the substrate 33. The entire structure would then be affixed to the shelf 5 shown in FIG. 1 in lieu of the template 7. Although the supported filter 30 will have greater signal losses than the template 7 shown in FIG. 1, the supported filter element 30 can be fabricated very inexpensively.

FIG. 3 illustrates another embodiment of the present invention using an edge-coupled filter fabricated from a plurality of ribbons suspended in a cavity in an LTCC structure.

As shown in FIG. 3, a plurality of ribbons 35 are suspended in a cavity 37 in an LTCC structure 41. A ribbon bonder (not shown) may be used to bond the ends of each ribbon 35 to platforms 39 made in the LTCC structure 41. Each ribbon 35 is taut and the platforms 39 are designed and patterned for proper impedance or grounding. The impedance of the system is also governed by the width of the ribbons and the separation distance of the ground planes 43 and 45. All other aspects of the structure, including ground planes 43 and 45 and transmission lines 47 and 49, are as shown in FIG. 1 and described above, except that the edge-coupled filter does not require any grounding of its ribbon elements.

Figure 4:
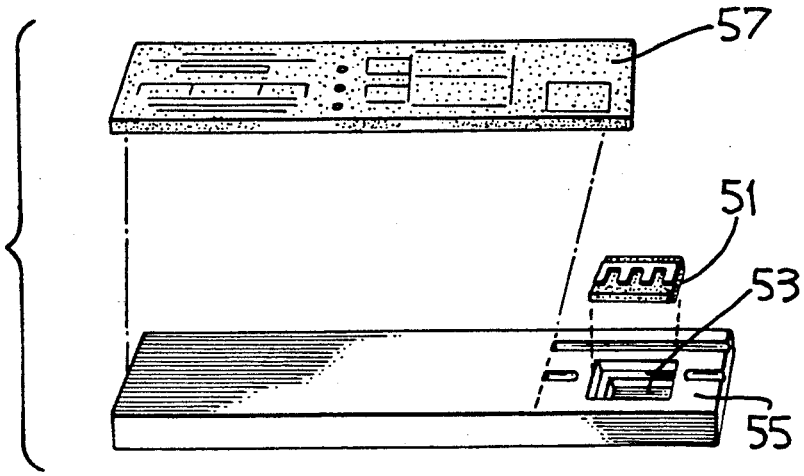
FIG. 4 illustrates a still further embodiment of the invention in which associated electronic circuitry is fully integrated with the airline configuration in a single LTCC package.

FIG. 4 illustrates an LTCC structure containing an airline configuration and associated electronic circuitry in a fully integrated package.

As shown in FIG. 4, a filter element 51 is suspended in a cavity 53 in an LTCC structure 55. Although the filter element 51 is illustrated as being of the type shown in FIG. 2, it could as well be of the type shown in FIG. or FIG. 3 or of other types. Associated electric circuitry 57 is also embedded in the LTCC structure 55 using well known techniques. This associated circuitry can be electrically interconnected with the airline structure and used to perform a processing function related to the airline structure. All other aspects of the LTCC airline filter are shown and described above in connection with FIGS. 1 and/or 3.

The result is a fully integrated package. For very high microwave frequencies, the size of the cavity necessary for the airline filter approaches the size of the cavities into which die and other discrete components (e.g. capacitors and resistors) are mounted. Because a multi-cavity, multi-layered ceramic structure is needed to package the associated electronic circuitry 57, minimal accommodations have to be made to provide additional cavities for the airline transmission portion of the system. This type of integration also serves to reduce the number of transitions between dissimilar packaging media (e.g. waveguides, coaxes, striplines, and microstrips), thereby eliminating potential sources for signal loss.

Although certain embodiments and features of the present invention have now been illustrated and discussed, it is to be understood that the present invention is applicable to a wide variety of embodiments and features.

For example, although having been discussed in the context of certain types of filters, the present invention is applicable to other types of filters, as well as to amplifiers, diode switches, combiners, and other electronic devices which need a metallic cavity for isolation or to provide a low-loss environment. Although only two parallel metallic ground planes have been shown and discussed, moreover, it is to be understood that the present invention also contemplate a cavity which is fully surrounded by metallic surfaces. This can be easily accomplished by metallizing the sides of the LTCC structures or internally through a network of vias, as well as their tops and bottoms. Although suspension has been accomplished through the use of a shelf completely surrounding the perimeter of the suspended devices, a lesser degree of support is also contemplated, as well as the use of the different techniques for support. The cavities, as well, can vary markedly in shape or position. Dual transmission lines are also not always essential.

In short, the present invention is intended to be limited solely by the following claims and their equivalences.

What is claimed is:

1. An airline filter in a low temperature cofired ceramic for filtering electronic signals comprising:

a. a low temperature co-fired ceramic structure;
b. a cavity within said ceramic structure;
c. at least one ground plane in proximity of said cavity and affixed to said ceramic structure;
d. an airline filter suspended within said cavity; and
e. connection means for connecting the electronic signals to said airline filter.

2. The airline filter of claim 1 wherein said filter includes a template of a combline filter.

3. The airline filter of claim 1 wherein said filter includes an element supported on a low-loss dielectric substrate.

4. The airline filter of claim 1 wherein said cavity includes a shelf to support said filter and wherein said filter is affixed to said shelf.

5. The airline filter of claim 4 wherein said filter includes a plurality of resonating stubs affixed at each end to said shelf.

6. The airline filter of claim 1 including two ground planes which surround said cavity.

7. The airline filter of claim 6 wherein said ceramic structure has a bottom and a top cover having an underneath side, wherein one of said ground planes includes a metallic surface affixed to said bottom, and wherein said other ground plane includes a metallic surface affixed to said underneath side.

8. The airline filter of claim 1 wherein said cavity is fully surrounded by metallic surfaces.

9. The airline filter of claim 1 wherein said connection means includes:

a. a first microstrip affixed to said ceramic structure for connection with the electronic signals;
b. a second microstrip affixed to said ceramic structure and connected to said filter; and
c. a stripline contained within said ceramic structure and connected between said first and second microstrip.

10. An airline structure in a low temperature cofired ceramic for processing microwave signals comprising:

a. a low temperature co-fired ceramic structure;
b. a cavity within said ceramic structure;
c. at least one ground plane in proximity of said cavity and affixed to said ceramic structure;
d. electronic processing circuitry suspended within said cavity; and
e. connection means for connecting the microwave signals to said processing circuitry.

11. A low temperature co-fired ceramic structure for processing microwave signals comprising:
a. a low temperature co-fired ceramic structure;
b. a cavity within said ceramic structure;
c. at least one ground plane in proximity to said cavity and affixed to said ceramic structure;
d. first processing circuitry suspended within said cavity for processing the microwave signals;
e. second processing circuitry contained within said ceramic structure, but not within said cavity, for processing signals; said second processing circuitry performing a function which is related to the function performed by said first processing circuitry; and
f. connection means for electrically interconnecting said first and second processing circuitry.

* * * * *